US011773751B1

(12) United States Patent
Freeman et al.

(10) Patent No.: US 11,773,751 B1
(45) Date of Patent: Oct. 3, 2023

(54) CERAMIC MATRIX COMPOSITE BLADE TRACK SEGMENT WITH PIN-LOCATING THREADED INSERT

(71) Applicant: Rolls-Royce Corporation, Indianapolis, IN (US)

(72) Inventors: Ted J. Freeman, Danville, IN (US); Aaron D. Sippel, Zionsville, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 18/071,196

(22) Filed: Nov. 29, 2022

(51) Int. Cl.
*F01D 11/08* (2006.01)
*F01D 25/24* (2006.01)

(52) U.S. Cl.
CPC ..... *F01D 25/246* (2013.01); *F01D 11/08* (2013.01); *F05D 2230/644* (2013.01); *F05D 2240/11* (2013.01); *F05D 2300/6033* (2013.01)

(58) Field of Classification Search
CPC ..... F01D 11/08; F01D 25/24; F01D 25/243; F01D 25/246; F05D 2240/11
See application file for complete search history.

(56) References Cited

U.S. PATENT DOCUMENTS

| | | | |
|---|---|---|---|
| 3,066,911 | A | 12/1962 | Frederick, V et al. |
| 3,807,891 | A | 4/1974 | Mc Dow et al. |
| 3,880,435 | A | 4/1975 | Thornbald |
| 4,676,715 | A | 6/1987 | Imbault et al. |
| 4,863,345 | A | 9/1989 | Thompson et al. |
| 5,080,557 | A | 1/1992 | Berger |
| 5,116,199 | A | 5/1992 | Ciokajlo |
| 5,203,673 | A | 4/1993 | Evans |
| 5,295,787 | A | 3/1994 | Leonard et al. |
| 5,459,995 | A | 10/1995 | Norton et al. |
| 5,584,651 | A | 12/1996 | Pietraszkiewicz et al. |
| 5,593,276 | A | 1/1997 | Proctor et al. |
| 5,609,469 | A | 3/1997 | Worley et al. |
| 6,142,731 | A | 11/2000 | Dewis et al. |
| 6,821,085 | B2 | 11/2004 | Darkins et al. |
| 6,877,952 | B2 | 4/2005 | Wilson |
| 6,884,026 | B2 | 4/2005 | Glynn et al. |
| 7,210,899 | B2 | 5/2007 | Wilson, Jr. |
| 7,494,317 | B2 | 2/2009 | Keller et al. |
| 7,534,086 | B2 | 5/2009 | Mazzola et al. |
| 7,726,936 | B2 | 6/2010 | Keller et al. |
| 7,753,643 | B2 | 7/2010 | Gonzalez et al. |
| 8,128,350 | B2 | 3/2012 | Schiavo et al. |
| 8,388,309 | B2 | 3/2013 | Marra et al. |
| 8,790,067 | B2 | 7/2014 | Mccaffrey et al. |
| 8,905,709 | B2 | 12/2014 | Dziech et al. |
| 8,944,756 | B2 | 2/2015 | Lagueux |
| 8,979,489 | B2 | 3/2015 | Taillant et al. |
| 9,587,504 | B2 | 3/2017 | Mccaffrey et al. |

(Continued)

FOREIGN PATENT DOCUMENTS

| | | | |
|---|---|---|---|
| FR | 3056636 | A1 | 3/2018 |

*Primary Examiner* — David E Sosnowski
*Assistant Examiner* — Maxime M Adjagbe
(74) *Attorney, Agent, or Firm* — Barnes & Thornburg LLP

(57) ABSTRACT

A turbine shroud assembly includes a carrier segment and a blade track segment. The carrier segment includes an outer wall, a first mount flange, and a second mount flange having a chordal seal. The blade track segment includes a shroud wall and an attachment feature. The mount assembly couples the blade track segment to the carrier segment.

20 Claims, 4 Drawing Sheets

(56) References Cited

U.S. PATENT DOCUMENTS

| | | | |
|---|---|---|---|
| 9,587,517 | B2 | 3/2017 | Vetters et al. |
| 9,863,265 | B2 | 1/2018 | Stapleton |
| 9,874,104 | B2 | 1/2018 | Shapiro |
| 10,024,193 | B2 | 7/2018 | Shapiro |
| 10,030,541 | B2 | 7/2018 | Vetters et al. |
| 10,082,039 | B2 | 9/2018 | Hanson |
| 10,132,197 | B2 | 11/2018 | Heitman et al. |
| 10,174,628 | B2 | 1/2019 | Humhauser et al. |
| 10,301,960 | B2 | 5/2019 | Stapleton et al. |
| 10,370,991 | B2 | 8/2019 | Wilson et al. |
| 10,378,385 | B2 | 8/2019 | Tesson et al. |
| 10,378,386 | B2 | 8/2019 | Roussille et al. |
| 10,415,426 | B2 | 9/2019 | Quennehen et al. |
| 10,415,427 | B2 | 9/2019 | Quennehen et al. |
| 10,422,241 | B2 | 9/2019 | Mccaffrey et al. |
| 10,428,688 | B2 | 10/2019 | Quennehen et al. |
| 10,577,963 | B2 | 3/2020 | Mccaffrey |
| 10,590,803 | B2 | 3/2020 | Quennehen et al. |
| 10,598,045 | B2 | 3/2020 | Tableau et al. |
| 10,605,120 | B2 | 3/2020 | Quennehen et al. |
| 10,619,517 | B2 | 4/2020 | Quennehen et al. |
| 10,626,745 | B2 | 4/2020 | Roussille et al. |
| 10,655,501 | B2 | 5/2020 | Lepretre et al. |
| 10,689,998 | B2 | 6/2020 | Stapleton et al. |
| 10,690,007 | B2 | 6/2020 | Quennehen et al. |
| 10,724,399 | B2 | 7/2020 | Carlin et al. |
| 10,753,221 | B2 | 8/2020 | Barker et al. |
| 10,787,924 | B2 | 9/2020 | Quennehen et al. |
| 10,815,810 | B2 | 10/2020 | Barker et al. |
| 10,907,487 | B2 | 2/2021 | Zurmehly et al. |
| 10,907,501 | B2 | 2/2021 | Filippi et al. |
| 10,934,872 | B2 | 3/2021 | Tableau et al. |
| 10,968,761 | B2 | 4/2021 | Barker et al. |
| 11,015,613 | B2 | 5/2021 | Kerns et al. |
| 11,021,988 | B2 | 6/2021 | Tableau et al. |
| 11,021,990 | B2 | 6/2021 | Filippi |
| 11,028,720 | B2 | 6/2021 | Tableau et al. |
| 11,041,399 | B2 | 6/2021 | Utjen et al. |
| 11,047,245 | B2 | 6/2021 | Mccaffrey |
| 11,066,947 | B2 * | 7/2021 | Sippel ..... F01D 25/246 |
| 11,078,804 | B2 | 8/2021 | Tableau et al. |
| 11,085,316 | B2 | 8/2021 | Barker et al. |
| 11,085,317 | B2 | 8/2021 | Johnson et al. |
| 11,111,822 | B2 | 9/2021 | Tableau et al. |
| 11,111,823 | B2 | 9/2021 | Jarrossay et al. |
| 11,143,050 | B2 | 10/2021 | Roy Thill et al. |
| 11,174,747 | B2 | 11/2021 | Roy Thill et al. |
| 11,174,795 | B2 | 11/2021 | Lutjen et al. |
| 11,215,064 | B2 | 1/2022 | Arbona et al. |
| 11,215,081 | B2 | 1/2022 | Schilling et al. |
| 11,255,209 | B2 | 2/2022 | Clark et al. |
| 11,326,470 | B2 | 5/2022 | Dyson et al. |
| 11,365,635 | B2 | 6/2022 | Read et al. |
| 11,441,434 | B2 | 9/2022 | Danis et al. |
| 11,466,585 | B2 | 10/2022 | Arbona et al. |
| 2009/0208284 | A1 | 8/2009 | Funnell |
| 2016/0186611 | A1 | 6/2016 | Vetters et al. |
| 2016/0186999 | A1 | 6/2016 | Freeman et al. |
| 2016/0319688 | A1 | 11/2016 | Thibault et al. |
| 2016/0333715 | A1 | 11/2016 | Mccaffrey |
| 2017/0268366 | A1 | 9/2017 | Mccaffrey et al. |
| 2018/0051581 | A1 | 2/2018 | Quennehen et al. |
| 2018/0051591 | A1 | 2/2018 | Quennehen et al. |
| 2018/0073398 | A1 | 3/2018 | Quennehen et al. |
| 2018/0080343 | A1 | 3/2018 | Groleau et al. |
| 2018/0156069 | A1 | 6/2018 | Quennehen et al. |
| 2018/0291769 | A1 | 10/2018 | Vetters et al. |
| 2018/0355761 | A1 | 12/2018 | Maar |
| 2019/0040758 | A1 | 2/2019 | Quennehen et al. |
| 2019/0040761 | A1 | 2/2019 | Carlin et al. |
| 2019/0084892 | A1 | 3/2019 | Subramanian et al. |
| 2019/0101027 | A1 | 4/2019 | Lepretre et al. |
| 2019/0128132 | A1 | 5/2019 | Tableau et al. |
| 2021/0131300 | A1 * | 5/2021 | Arbona ..... F01D 25/246 |
| 2021/0189909 | A1 * | 6/2021 | Sippel ..... F01D 11/08 |
| 2021/0254503 | A1 * | 8/2021 | Roy Thill ..... F01D 25/12 |
| 2022/0003126 | A1 | 1/2022 | Roy Thill et al. |
| 2022/0056809 | A1 | 2/2022 | Hock et al. |
| 2022/0120198 | A1 | 4/2022 | Schilling et al. |

* cited by examiner

CERAMIC MATRIX COMPOSITE BLADE TRACK SEGMENT WITH PIN-LOCATING THREADED INSERT

FIELD OF THE DISCLOSURE

The present disclosure relates generally to gas turbine engines, and more specifically to pin-locating threaded inserts for turbine shrouds.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Compressors and turbines typically include alternating stages of static vane assemblies and rotating wheel assemblies. The rotating wheel assemblies include disks carrying blades around their outer edges. When the rotating wheel assemblies turn, tips of the blades move along blade tracks included in static shrouds that are arranged around the rotating wheel assemblies. Such static shrouds may be coupled to an engine case that surrounds the compressor, the combustor, and the turbine.

Some shrouds positioned in the turbine may be exposed to high temperatures from products of the combustion reaction in the combustor. Such shrouds sometimes include components made from materials that have different coefficients of thermal expansion. Due to the differing coefficients of thermal expansion, the components of some turbine shrouds expand at different rates when exposed to combustion products. In some examples, coupling such components with traditional fasteners such as rivets or bolts may not allow for the differing levels of expansion and contraction during operation of the gas turbine engine.

SUMMARY

The present disclosure may comprise one or more of the following features and combinations thereof.

A turbine shroud assembly for use with a gas turbine engine may include a carrier segment, a blade track segment, and a mount assembly. The carrier segment may be made of metallic materials and arranged circumferentially at least partway around an axis. The carrier segment may have an outer wall, a first mount flange, and a second mount flange. The first mount flange may extend radially inward from the outer wall. The second mount flange may be axially spaced apart from the first mount flange and extend radially inward from the outer wall. The second mount flange may include a radially extending wall and a chordal seal that extends axially away from the radially extending wall.

In some embodiments, the blade track segment may be made of ceramic matrix composite materials and may supported by the carrier to locate the blade track segment radially outward of the axis and define a portion of a gas path of the turbine shroud assembly. The blade track segment may include a shroud wall that extends circumferentially partway around the axis and an attachment feature that extends radially outward from the shroud wall.

In some embodiments, the mount assembly may include a mount pin, a mount insert, and a mount plug. The mount pin may extend into the first mount flange, through the attachment feature, and into the second mount flange so as to couple the blade track segment to the carrier segment. The mount insert may be press fit into the first mount flange of the carrier segment axially forward of the mount pin and circumferentially aligned with the mount pin. The mount plug may be configured to mate with corresponding threads on the mount insert to apply an axial force to the mount pin to urge the attachment feature of the black track segment into engagement with the chordal seal of the second mount flange to axially locate the mount pin and the blade track segment relative to the carrier segment.

In some embodiments, the mount plug may include a main body and a tab. The main body may be shaped to include threads that mate with corresponding threads on the mount insert. The tab may extend axially away from the main body and engage an axially forward facing surface of the mount pin.

In some embodiments, the first mount flange of the carrier segment may be formed to define a stepped pin hole that extends axially through the first mount flange and configured to receive the mount insert and the mount plug. The stepped pin hole may be shaped to include a step surface spaced apart axially from an axially forward facing surface of the first mount flange. The mount insert may engage the step surface when the mount insert is press fit into the carrier segment to axially locate the mount insert relative to the first mount flange of the carrier segment.

In some embodiments, the mount pin may be shaped to include a step. The step may define an axially facing step face that engages the attachment feature to urge the attachment feature into engagement with the chordal seal.

In some embodiments, the attachment feature may include a first attachment flange and a second attachment flange. The first attachment flange may extend radially from the shroud wall. The second attachment flange may be spaced apart axially aft from the first attachment flange that extends radially from the shroud wall. The axially facing step face of the step included in the mount pin may engage the second attachment flange.

In some embodiments, the mount pin may include a forward pin and an aft pin. The forward pin may extend into the first mount flange and through the first attachment flange. The aft pin may be circumferentially aligned with and aft of the forward pin and may extend through the second attachment flange and into the second mount flange. The forward pin may be separate from the aft pin so as to allow for independent loading during use in the gas turbine engine.

In some embodiments, the attachment feature may include a first attachment flange and a second attachment flange. The first attachment flange may extend radially from the shroud wall. The second attachment flange may be spaced apart axially aft from the first attachment flange that extends radially from the shroud wall. The axially facing step face of the step included in the mount pin may engage the first attachment flange.

In some embodiments, the mount insert and the mount plug may comprise the same metallic materials to prevent the threads from seizing. The metallic materials of the mount insert and the mount plug may be different from the metallic materials of the carrier segment.

According to another aspect of the present disclosure, a turbine shroud assembly may include a carrier segment, a blade track segment, and a mount assembly. A carrier segment may be arranged circumferentially at least partway around an axis. The carrier segment may have an outer wall, a first mount flange, and a second mount flange. The first mount flange may extend radially inward from the outer wall. The second mount flange may be axially spaced apart from the first mount flange and may extend radially inward from the outer wall. The second mount flange may be shaped to include a chordal seal.

In some embodiments, a blade track segment may be supported by the carrier segment. The blade track segment may include a shroud wall that extends circumferentially partway around the axis and an attachment feature that extends radially outward from the shroud wall.

In some embodiments, a mount assembly may include a mount pin, a mount insert, and a mount plug. The mount pin may extend into the first mount flange, through the attachment feature, and into the second mount flange so as to couple the blade track segment to the carrier segment. The mount insert may be press fit into the first mount flange of the carrier segment axially forward of the mount pin and circumferentially aligned with the mount pin. The mount plug may be configured to mate with corresponding threads on the mount insert to apply an axial force to the mount pin.

In some embodiments, the mount plug may include a main body and a tab. The tab may extend axially away from the main body and may engage the mount pin.

In some embodiments, the first mount flange of the carrier segment may be formed to define a stepped pin hole that extends axially through the first mount flange and configured to receive the mount insert and the mount plug. The stepped pin hole may be shaped to include a step surface spaced apart axially from an axially forward facing surface of the first mount flange. The mount insert may engage the step surface when the mount insert is press fit into the carrier segment to axially locate the mount insert relative to the first mount flange of the carrier segment In some embodiments, the mount pin may be shaped to include a step. The step may define an axially facing step face that engages the attachment feature to urge the attachment feature into engagement with the chordal seal.

In some embodiments, the attachment feature may include a first attachment flange and a second attachment flange. The first attachment flange may extend radially from the shroud wall. The second attachment flange may be spaced apart axially aft from the first attachment flange. The axially facing step face of the step included in the mount pin may engage the second attachment flange.

In some embodiments, the attachment feature may include a first attachment flange and a second attachment flange. The first attachment flange may extend radially from the shroud wall. The second attachment flange may be spaced apart axially aft from the first attachment flange that extends radially from the shroud wall. The axially facing step face of the step included in the mount pin may engage the first attachment flange.

In some embodiments, the mount insert and the mount plug may comprise the same metallic materials. The metallic materials of the mount insert and the mount plug may be different from the metallic materials of the carrier segment.

A method of forming a turbine shroud assembly may include providing a carrier segment made of metallic materials arranged to extend circumferentially at least partway around an axis, a blade track segment made of ceramic matrix composite materials, and a mount assembly. The carrier segment may have an outer wall, a first mount flange, and a second mount flange. The first mount flange may extend radially inward from the outer wall. The second mount flange may be axially spaced apart from the first mount flange and may extend radially inward from the outer wall. The second mount flange may be shaped to include a chordal seal. The blade track segment may include a shroud wall and an attachment feature. The shroud wall may extend circumferentially partway around the axis. The attachment feature may extend radially outward from the shroud wall. The mount assembly may include a mount pin, a mount insert, and a mount plug.

In some embodiments, the method may further include arranging the blade track segment adjacent the carrier segment so that the attachment feature is adjacent the second mount flange of the carrier segment.

In some embodiments, the method may further include inserting the mount pin into the first mount flange, through the attachment feature, and into the second mount flange so as to couple the blade track segment to the carrier segment.

In some embodiments, the method may further include inserting the mount insert into the first mount flange of the carrier segment after inserting the mount pin.

In some embodiments, the method may further include threading the mount plug to the mount insert to apply an axial force to the mount pin to urge the attachment feature of the black track segment into engagement with the chordal seal formed on the second mount flange to axially locate the mount pin and the blade track segment relative to the carrier segment.

In some embodiments, the mount insert and the mount plug may comprise the same metallic materials, and the metallic materials of the mount insert and the mount plug may be different from the metallic materials of the carrier segment.

In some embodiments, the mount plug may include a main body shaped to include threads that mate with corresponding threads on the mount insert and a tab that extends axially away from the main body and engages an axially forward facing surface of the mount pin.

In some embodiments, the attachment feature may include a first attachment flange that extends radially from the shroud wall and a second attachment flange spaced apart axially aft from the first attachment flange that extends radially from the shroud wall. The mount pin may be shaped to include a step defining an axially facing step face that engages the second attachment flange to urge the attachment feature into engagement with the chordal seal.

These and other features of the present disclosure will become more apparent from the following description of the illustrative embodiments

DETAILED DESCRIPTION OF THE DRAWINGS

Figure 1:
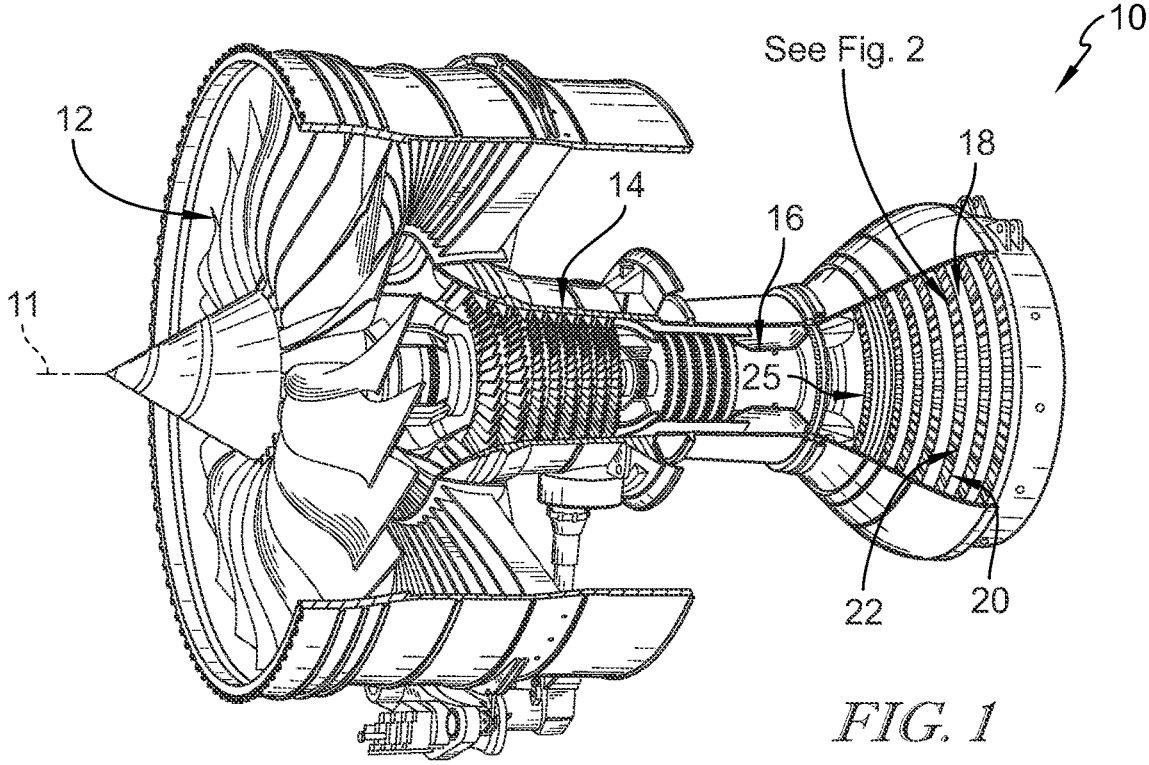
FIG. 1 is a cutaway perspective view of a gas turbine engine that includes a fan, a compressor, a combustor, and a turbine, the turbine including a turbine shroud that extends circumferentially around the axis and turbine wheels that are driven to rotate about an axis of the engine to generate power.

For the purposes of promoting an understanding of the principles of the disclosure, reference will now be made to a number of illustrative embodiments illustrated in the drawings and specific language will be used to describe the same.

An illustrative aerospace gas turbine engine 10 includes a fan 12, a compressor 14, a combustor 16, and a turbine 18 as shown in FIG. 1. The fan 12 is driven by the turbine 18 and provides thrust for propelling an air vehicle. The compressor 14 compresses and delivers air to the combustor 16. The combustor 16 mixes fuel with the compressed air received from the compressor 14 and ignites the fuel. The hot, high-pressure products of the combustion reaction in the combustor 16 are directed into the turbine 18 to cause the turbine 18 to rotate about an axis 11 and drive the compressor 14 and the fan 12. In some embodiments, the fan 12 may be replaced with a propeller, drive shaft, or other suitable configuration.

Figure 2:
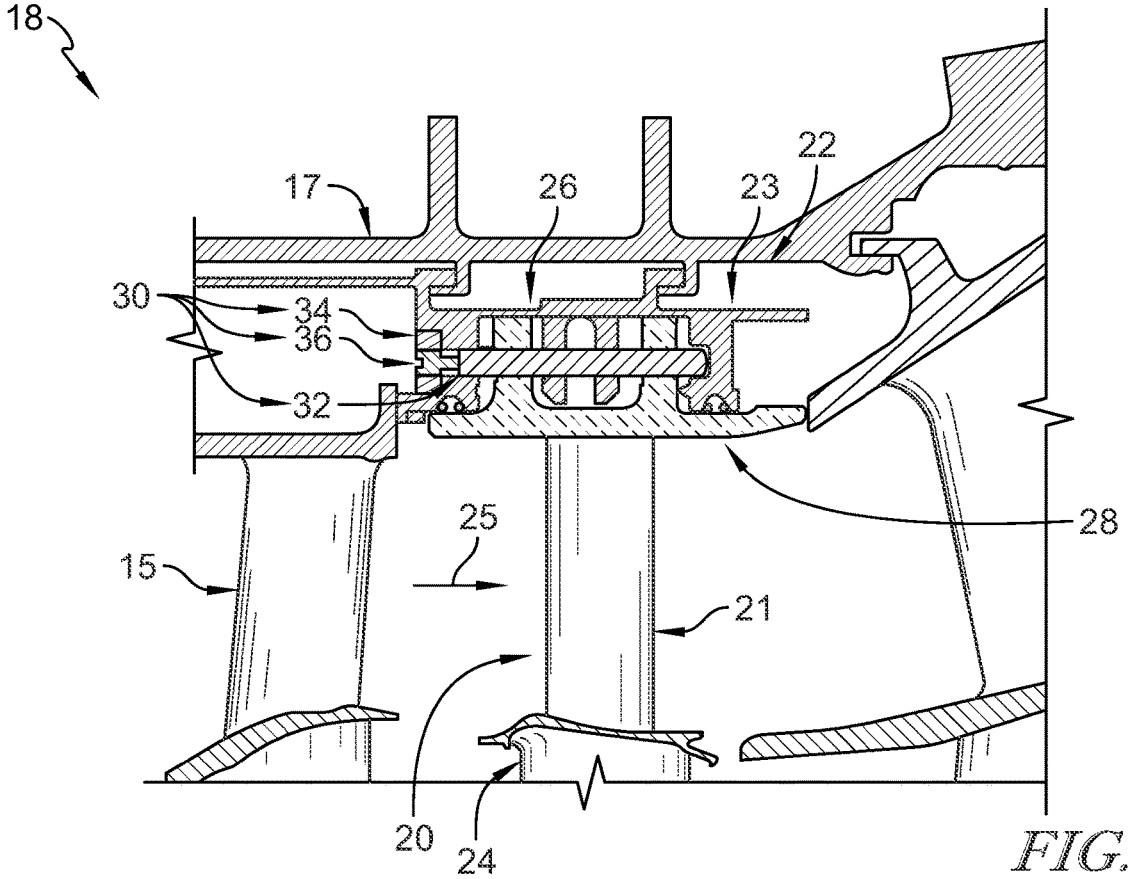
FIG. 2 is a cross-sectional view of a portion of the turbine included in the gas turbine engine of FIG. 1 showing one of the turbine wheel assemblies and the turbine shroud assembly arranged around the turbine wheel assembly, the turbine shroud assembly including a carrier segment, a blade track segment that defines a portion of a gas path of the turbine shroud assembly, and a mount assembly having a mount pin that couples the blade track segment to the carrier segment, a mount insert that is press fit into the carrier segment axially forward of the mount pin, and a mount plug that mates with corresponding threads on the mount insert to apply an axial force to the mount pin so as to urge the blade track segment into sealing engagement with a chordal seal formed on the carrier segment.

The turbine 18 includes at least one turbine wheel assembly 20 and a turbine shroud 22 positioned to surround the turbine wheel assembly 20 as shown in FIGS. 1 and 2. The turbine wheel assembly 20 includes a plurality of blades 21 coupled to a rotor disk 24 for rotation with the rotor disk 24. The hot, high-pressure combustion products from the combustor 16 are directed toward the blades 21 of the turbine wheel assemblies 20 along a gas path 25. The turbine wheel assembly 20 further includes a plurality of vanes 15 as shown in FIG. 2. The turbine shroud 22 is coupled to an outer case 17 of the gas turbine engine 10 and extends around the turbine wheel assembly 20 to block gases from passing over the blades 21 during use of the turbine 18 in the gas turbine engine 10.

Figure 3:
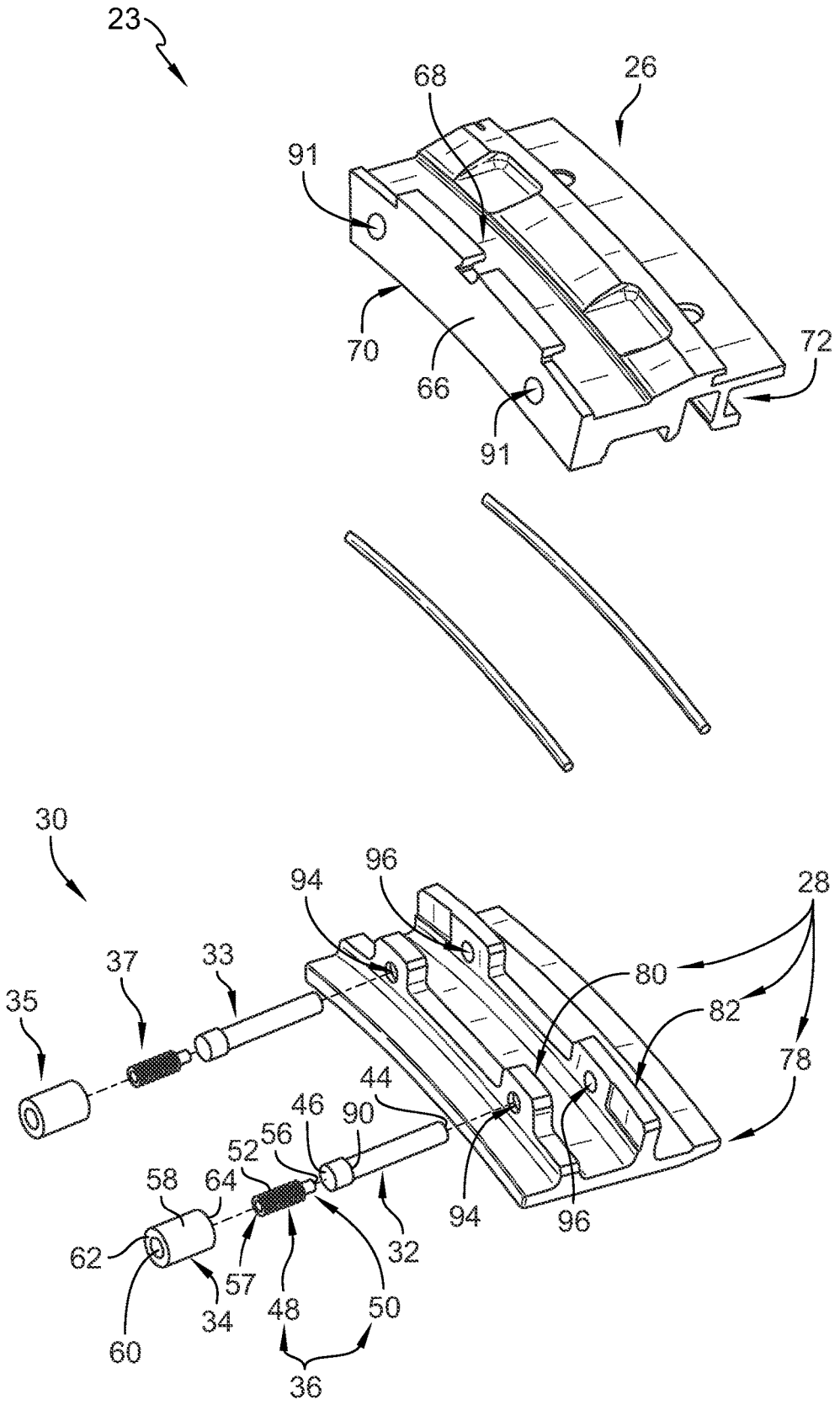
FIG. 3 is an exploded view of the turbine shroud assembly of FIG. 2 showing, from top to bottom, the carrier segment, the blade track segment, and the mount assembly, and further showing the mount assembly includes two mount pins circumferentially spaced apart from one another, two mount plugs that each correspond to one of the mount pins, and two mount inserts that each correspond to one of the mount plugs.
Figure 4:
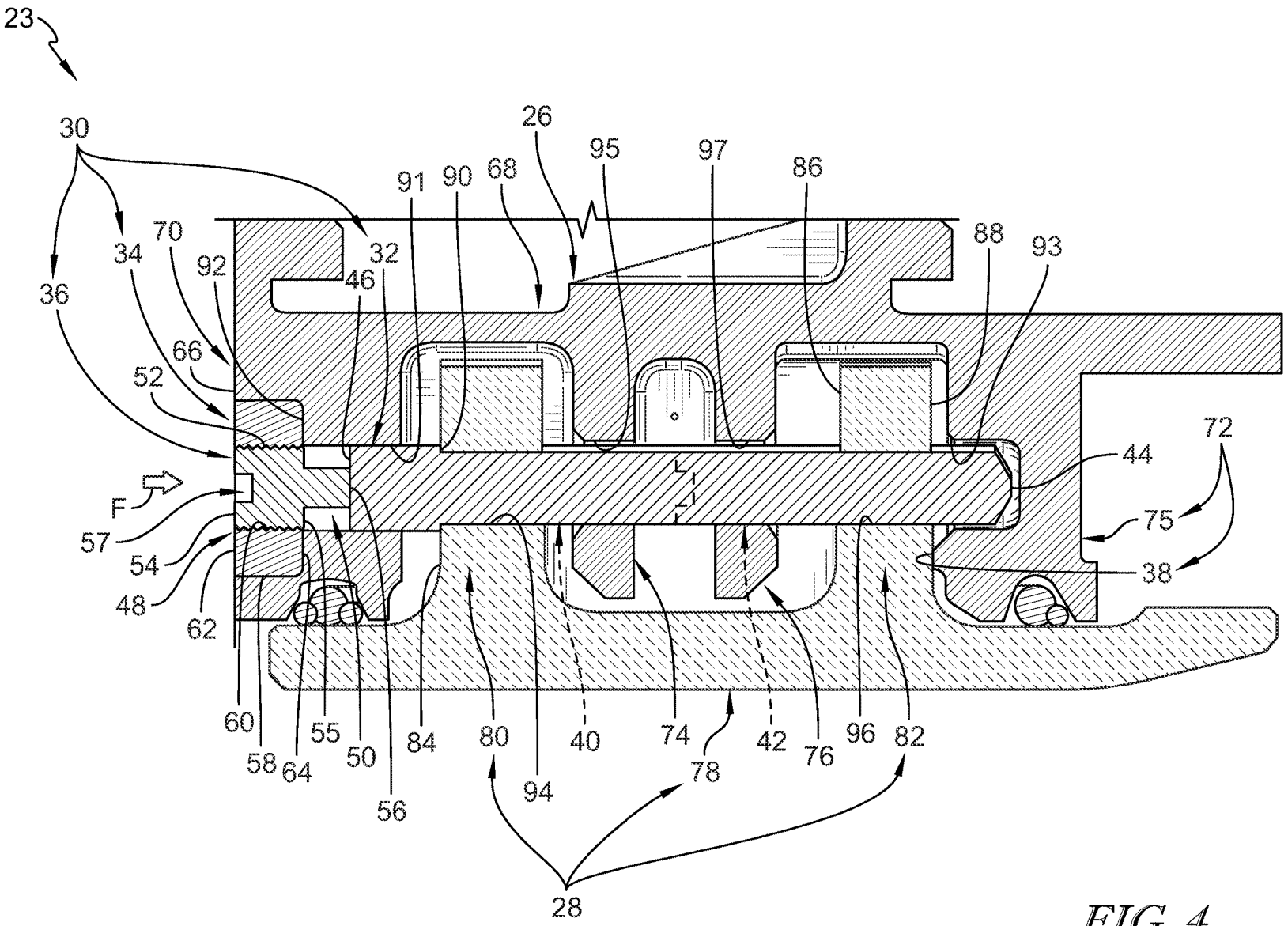
FIG. 4 is a detailed view of the turbine shroud assembly of FIG. 2 showing the blade track segment includes a shroud wall that defines the portion of the gas path and two attachment flanges that extend radially outward from the shroud wall toward the carrier segment, and further showing the mount plug applies the axial force to the mount pin to cause a step face of the mount pin to engage a first attachment flange of the blade track segment so that the blade track segment is urged into engagement with the chordal seal formed on the carrier segment.

The turbine shroud 22 includes a turbine shroud assembly 23 having a carrier segment 26, a blade track segment 28, and a mount assembly 30 as shown in FIGS. 2-4. The carrier segment 26 is made of metallic materials and arranged circumferentially around the axis 11. The blade track segment 28 is made of ceramic matrix composite materials and is supported by the carrier segment 26 to locate the blade track segment 28 radially outward of the axis 11 to define a portion of the gas path 25. The mount assembly 30 is configured to couple the blade track segment 28 to the carrier segment 26, while also locating the blade track segment 28 relative to the carrier segment 26 to improve sealing between the blade track segment 28 and the carrier segment 26.

The mount assembly 30 includes a mount pin 32, a mount insert 34, and a mount plug 36 as shown in FIGS. 2-4. The mount pin 32 extends into the carrier segment 26 and the blade track segment 28 to couple the blade track segment 28 to the carrier segment 26. The mount insert 34 is press fit into the carrier segment 26 axially forward of the mount pin 32 and circumferentially aligned with the mount pin 32. The mount plug 36 is configured to mate with corresponding threads on the mount insert 34 to apply an axial force F to the mount pin 32. The axial force F applied by the mount plug 36 urges the blade track segment 28 into engagement with a chordal seal 38 formed on the carrier segment 26 to axially locate the mount pin 32 and the blade track segment 28 relative to the carrier segment 26.

In the illustrative embodiment, the blade track segment 28 comprises ceramic matrix composite materials, while the carrier segment 26 comprises metallic materials. Ceramic matrix composite materials can generally withstand higher temperatures than metallic materials. Therefore, the ceramic matrix composite blade track segment 28 may allow for increased temperatures within the turbine 18 as well as decreased cooling air usage such that the overall efficiency of the gas turbine engine 10 can be improved.

However, ceramic matrix composite materials may have a relatively low strength compared to the surrounding support structures such as the metallic carrier segment 26. Additionally, the ceramic matrix composite materials of the blade track segment 28 and the metallic materials of the carrier segment 26 grow and shrink at different rates when exposed to high and low temperatures due to the differing coefficients of thermal expansion of the materials. Therefore, methods of coupling the blade track segment 28 to the carrier segment 26 may be challenging.

In the illustrative embodiment, the turbine shroud assembly 23 includes the mount pin 32 to couple the blade track segment 28 to the carrier segment 26. To insert the mount pin 32 into the carrier segment 26 and the blade track segment 28, the carrier segment 26 may include holes to insert the mount pin 32 through. However, the carrier segment 26 may need another component to close the holes once the mount pin 32 is inserted and a way to bias the blade track segment 28 into position on the carrier segment 26.

Some embodiments may use springs between the blade track segment 28 and one of the carrier segment 26 and the mount pin 32 to bias the blade track segment 28 into sealing features on the carrier segment 26 and to axially locate the blade track segment 28 relative to the carrier segment 26. However, springs may not be robust enough at high temperatures and may not apply enough axial force to the blade track segment 28 and/or the mount pin 32.

Therefore, the turbine shroud assembly 23 includes the mount insert 34 and the mount plug 36 to apply the axial force F to the mount pin 32. The mount plug 36 is configured to mate with corresponding threads on the mount insert 34 to apply the axial force F to the mount pin 32. The mount plug 36 may be tightened or loosened to control the axial force F applied to the mount pin 32. Additionally, the thread engagement of the mount insert 34 and the mount plug 36 prevents the axial movement of the mount plug 36 so that axial force F is maintained during operation of the gas turbine engine 10.

Further, the mount insert 34 and the mount plug 36 enable the use of threads in the turbine shroud assembly 23 without having to create threads on the actual carrier segment 26. The carrier segment 26 is made of metallic materials that typically have a high hardness value to provide adequate structural support to the blade track segment 28 and to withstand high temperatures in the turbine 18. The high hardness value of these metallic materials may make machining the carrier segment 26 difficult. Therefore, the mount insert 34 and the mount plug 36 are made of different metallic materials than the carrier segment 26. The mount insert 34 and the mount plug 36 are made of the same metallic materials to prevent the threads from seizing.

The mount insert 34 and the mount plug 36 also restrict the flow of air through the hole 91 formed in the carrier segment 26 for the mount pin 32. The engagement of the carrier segment 26, the mount insert 34, and the mount plug 36 creates a seal and reduces air leakage from the cavity between the carrier segment 26 and the blade track segment 28.

In the illustrative embodiment, the materials that comprise the mount insert 34 and the mount plug 36 have a coefficient of thermal expansion that is greater than the materials that comprise the carrier segment 26. In some embodiments, the mount insert 34 and the mount plug 36 may have a coefficient of thermal expansion that is greater than 90% of coefficient of thermal expansion of the materials that comprise the carrier segment 26. In the illustrative embodiment, the mount assembly 30 includes two mount pins 32, 33 that each have a corresponding mount plug 36, 37 as shown in FIG. 3. Each mount plug 36, 37 has a corresponding mount insert 34, 35 as shown in FIG. 3 The two mount pins 32, 33, along with the corresponding mount insert 34, 35 and mount plug 36, 37 are spaced apart circumferentially from each other as shown in FIG. 3.

The mount pins 32, 33 of the mount assembly 30 couple the blade track segment 28 to the carrier segment 26 as shown in FIGS. 3 and 4. The mount pins 32, 33 each extend through the blade track segment 28 and into the carrier segment 26. Each mount insert 34, 35 is press fit into the carrier segment 26 axially forward of the corresponding mount pin 32, 33 and circumferentially aligned with the corresponding mount pin 32, 33. Each mount plug 36, 37 is configured to mate with threads on the corresponding mount insert 34, 35 to apply the axial force F to the corresponding mount pin 32, 33. The axial force F applied by each mount plug 36, 37 urges the blade track segment 28 into engagement with the chordal seal 38 formed on the carrier segment 26 to axially locate the mount pins 32, 33 and the blade track segment 28 relative to the carrier segment 26.

The mount pin 33, the mount insert 35, and the mount plug 37 are substantially similar to the mount pin 32, the mount insert 34, and the mount plug 36 in the illustrative embodiment. The mount pin 33, the mount insert 35, and the mount plug 37 are substantially similar to the mount pin 32, the mount insert 34, and the mount plug 36 such that description of the mount pin 32, the mount insert 34, and the mount plug 36 also applies to the mount pin 33, the mount insert 35, and the mount plug 37.

The mount pin 32 includes an aft end 44 and a forward end 46 as shown in FIGS. 3 and 4. The aft end 44 of the mount pin 32 defines an axially aft facing surface that faces the carrier segment 26. The forward end 46 of the mount pin 32 is opposite the aft end 44 and defines an axially forward facing surface that engages with the mount plug 36.

In one embodiment, the mount pin 32 is formed as a single pin as shown in FIGS. 2-4. The mount pin 32 may have a circular cross-section, or may have any other suitable cross-section.

In another embodiment, the mount pin 32 includes a forward pin 40 and an aft pin 42 as suggested by FIG. 4. The forward pin 40 and the aft pin 42 are circumferentially aligned. The forward pin 40 is located axially forward of the aft pin 42. In this embodiment, the forward pin 40 is separate from the aft pin 42 so as to allow for independent loading during use in the gas turbine engine 10.

In the embodiments where the mount pin 32 is a split pin with the forward pin 40 and the aft pin 42 as suggested in FIG. 4, the mount plug 36 engages the forward pin 40 to urge the blade track segment 28 into engagement with the chordal seal 38.

In the illustrative embodiment, the mount plug 36 is circumferentially aligned with the mount pin 32 and the mount insert 34 as shown in FIGS. 3 and 4. The mount plug 36 is located axially forward of the mount pin 32 and interior to the mount insert 34.

The mount plug 36 includes a main body 48 and a tab 50 as shown in FIGS. 3 and 4. The main body 48 forms threads 52 that mate with corresponding threads 60 on the mount insert 34. The tab 50 extends axially aft from the main body 48 to a terminal end 56 that engages the forward end 46 of the mount pin 32. Terminal end 56 of the tab 50 engages the forward end 46 of the mount pin 32 to apply the axial force F to the mount pin 32. The axial force F urges the blade track segment 28 into sealing engagement with the chordal seal 38 formed on the carrier segment 26. In the illustrative embodiment, the main body 48 has a larger diameter than the tab 50.

The main body 48 of the mount plug 36 includes an outer surface 52, a forward face 54, and an aft face 55 spaced apart axially from the forward face 54 as shown in FIGS. 3 and 4. The outer surface 52 of the main body 48 extends axially between the forward face 54 and the aft face 55. The outer surface 52 is formed to define the threads 52 that mate with the threads 60 of the mount insert 34. The forward face 54 defines an axially forward facing surface, while the aft face 55 defines an axially aft facing surface. In the illustrative embodiment, the tab 50 of the mount plug 36 extends axially aft from the aft face 55 of the main body 48.

In the illustrative embodiment, the forward face 54 of the mount plug 36 is formed to include a tool feature 57 configured to receive a tool used to thread the mount plug 36 with the mount insert 34. The tool feature 57 may be a hole for an Allen wrench as in the illustrative embodiment. In other embodiments, the tool feature 57 may be another type of hole for a different suitable tool to thread the mount plug 36 with the mount insert 34. The tool is used to thread the mount plug 36 with the mount insert 34 so as to apply the axial force F to the mount pin 32. In this way, the axial force F may be adjusted as needed.

The mount insert 34 includes an outer surface 58, an inner surface 60, a forward face 62, and an aft face 64 opposite the forward face 62 as shown in FIGS. 3 and 4. The outer and inner surfaces 58, 60 extend axially between and interconnect the forward face 62 and the aft face 64. The outer surface 58 of the mount insert 34 contacts the carrier segment 26 when the mount insert 34 is press fit into the carrier segment 26. The inner surface 60 defines a hole that extends axially through the mount insert 34 and receives the mount plug 36. The inner surface 60 of the mount insert 34 defines the threads 60 that mate with corresponding threads 52 on the main body 48 of the mount plug 36. The forward face 62 of the mount insert 34 defines an axially forward facing surface, while the aft face 64 of the mount insert 34 defines an axially aft facing surface that engages the carrier segment 26 to axially locate the mount insert 34 relative to the carrier segment 26 when the mount insert 34 is press fit with the carrier segment 26.

The forward face 62 of the mount insert 34 and the forward face 54 of the mount plug 36 are sub-flush to the forward facing surface 66 of the carrier segment 26. In this way, an upstream vane 15 may be able to load against the carrier segment 26 thereby simplifying the fastening arrangement therebetween. Turning again to the turbine shroud 22, the turbine shroud 22 is made up of a plurality of turbine shroud assemblies 23 in the illustrative embodiment. The turbine shroud assemblies 23 each extend circumferentially partway around the axis 11 and cooperate to surround the turbine wheel assembly 20. In other embodiments, the turbine shroud 22 is annular and non-segmented to extend fully around the axis 11 and surround the turbine wheel assembly 20. In yet other embodiments, certain components of the turbine shroud 22 are segmented while other components are annular and non-segmented.

Each turbine shroud assembly 23 includes the carrier segment 26, the blade track segment 28, and the mount assembly 30 as shown in FIGS. 2-4. The mount assembly 30 is configured to couple the blade track segment 28 to the carrier segment 26, while also locating the blade track segment 28 relative to the carrier segment 26 to improve sealing between the blade track segment 28 and the carrier segment 26.

The carrier segment 26 includes an outer wall 68 and a plurality of mount flanges 70, 72, 74, 76 as shown in FIGS. 3 and 4. The outer wall 68 extends circumferentially partway around the axis 11. The plurality of mount flanges 70, 72, 74, 76 extend radially inward from the outer wall 68 and have a circumferential extent that extends along the circumferential extent of the outer wall 68.

The plurality of mount flanges 70, 72, 74, 76 includes a first mount flange 70 and a second mount flange 72 as shown in FIGS. 3 and 4. The plurality of mount flanges 70, 72, 74, and 76 are each formed to include corresponding holes 91, 93, 95, and 97 that receive the mount pin 32 when the mount pin 32 is inserted into the carrier segment 26 and through the blade track segment 28. The first mount flange 70 extends radially inward from the outer wall 68. The second mount flange 72 is axially spaced apart from the first mount flange 70 and extends radially inward from the outer wall 68. In the illustrative embodiment, the first mount flange 70 is located at an axially forward end of the outer wall 68 and the second mount flange 72 is located at an axially aft end of the outer wall 68 as shown in FIGS. 3 and 4.

The first mount flange 70 is formed to include a pin hole 91 that extends axially through the first mount flange 70 as shown in FIG. 4. The mount pin 32 extends through the pin hole 91 when the mount pin 32 is inserted into the carrier segment 26 and through the blade track segment 28.

The pin hole 91 is a stepped hole that defines a mount insert blocker surface 92, also referred to as a step surface 92, as shown in FIG. 4. The mount insert blocker surface 92 is located axially aft of the forward facing surface 66 of the first mount flange 70. The mount insert blocker surface 92 engages the mount insert 34 when the mount insert 34 is press fit into the carrier segment 26 to axially locate the mount insert 34 relative to the first mount flange 70 of the carrier segment 26.

The second mount flange 72 includes a radially extending wall 75 and the chordal seal 38 as shown in FIG. 4. The chordal seal 38 extends axially away from the radially extending wall 75. The chordal seal 38 may, in addition to extending axially away from the wall 75, also extend circumferentially along the circumferential extent of the second mount flange 72 to seal off gases flowing along the gas path 25 radially within the blade track segment 28.

In the illustrative embodiment, the second mount flange 72 is formed to include a blind hole 93 that extends axially into the radially extending wall 75 as shown in FIG. 4. The blind hole 93 receives the aft end 44 of the mount pin 32 when the mount pin 32 is inserted into the carrier segment 26 and through the blade track segment 28.

In the illustrative embodiment, the carrier segment 26 further includes a third mount flange 74 and a fourth mount flange 76 as shown in FIG. 4. The third mount flange 74 extends radially inward from the outer wall 68 of the carrier segment 26. The fourth mount flange 76 extends radially inward from the outer wall 68 of the carrier segment 26. The fourth mount flange 76 is spaced apart from and located axially aft of the third mount flange 74 as shown in FIG. 4. The fourth mount flange 76 is located axially forward of the second mount flange 72. The third mount flange 74 is located axially aft of the first mount flange 70. The third and fourth mount flanges 74, 76 may be inner mount flanges or clevises that are both located axially inward of the first mount flange 70 and the second mount flange 72.

In the illustrative embodiment, the third and fourth mount flanges 74, 76 are formed to include pin holes 95, 97 as shown in FIG. 4. The pin holes 95, 97 receive the mount pin 32 when the mount pin 32 is inserted into the carrier segment 26 and through the blade track segment 28.

The blade track segment 28 includes a shroud wall 78 and an attachment feature 80, 82 as shown in FIGS. 3 and 4. The shroud wall 78 is arcuate and extends circumferential partway around the axis 11. The shroud wall 78 also extends a limited axial distance across the axis 11. The shroud wall 78 may extend beyond the second mount flange 72 in an axially aft direction.

The attachment feature 80, 82 extends radially outward from the shroud wall 78 as shown in FIGS. 3 and 4. In the illustrative embodiment, the attachment feature 80, 82 includes a first attachment flange 80 and a second attachment flange 82 that is spaced apart from and located axially aft of the first attachment flange 80. The first and the second attachment flanges 80, 82 are formed to include corresponding holes 99, 101 that receive the mount pin 32 when the mount pin 32 is inserted into the carrier segment 26 and through the blade track segment 28. The first attachment flange 80 may extend radially away from the shroud wall 78 the same distance as the second attachment flange 82. The first attachment flange 80 and the second attachment flange 82 provide structure for coupling the blade track segment 28 to the carrier segment 26.

The first attachment flange 80 extends radially outwardly such that the first attachment flange 80 is located axially between the first mount flange 70 and the third mount flange 74 as shown in FIGS. 3 and 4. The first attachment flange 80 has an axially forward facing surface 84.

The second attachment flange 82 extends radially outwardly such that the second attachment flange 82 is located axially between the fourth mount flange 76 and the second mount flange 72 as shown in FIG. 4. The second attachment flange 82 includes an axially forward facing surface 86 and an axially aft facing surface 88 opposite the axially forward facing surface 86. The axially aft facing surface 88 contacts the chordal seal 38 of the second mount flange 72 such that gases flowing along the gas path 25 radially within the blade track segment 28 are sealed off.

The mount pin 32 of the mount assembly 30 extends into the pin hole 91 formed in the first mount flange 70, through the pin hole 99 formed in the first attachment flange 80, through the pin holes 95, 97 formed in the third and fourth mount flanges 74, 76, through the pin hole 101 formed in the second attachment flange 82, and into the blind hole 93 formed in the second mount flange 72. The mount insert 34 is located in the pin hole 91 such that the aft face 64 of the mount insert 34 engages the mount insert blocker surface 92 of the pin hole 91. The mount plug 36 is threadly coupled to the mount insert 34.

In one embodiment, the mount pin 32 further includes a step 90 as shown in FIGS. 3 and 4. The step 90 defines an axially facing step face that engages the first attachment flange 80 of the blade track segment 28 to urge the blade track segment 28 into engagement with the chordal seal 38 of the carrier segment 26. The step 90 contacts the axially forward facing surface 84 of the first attachment flange 80.

The aft face 64 of the mount insert 34 contacts the mount insert blocker surface 92 of the first mount flange 70 when the mount insert 34 is press fit into the carrier segment 26 as shown in FIG. 4. The engagement between the aft face 64 and the mount insert blocker surface 92 ensures a secure fit between the mount insert 34, the mount plug 36, and the carrier segment 26. This secure fit enables the terminal end 56 of the mount plug 36 to apply the axial force F to the mount pin 32. The axial force F urges the step 90 of the mount pin 32 to engage with the attachment feature 80, 82 of the blade track segment 28.

This engagement urges the second attachment flange 82 of the blade track segment 28 into contact with the chordal seal 38 of the second mount flange 72. When the second attachment flange 82 engages the chordal seal 38, the axially aft facing surface 88 of the second attachment flange 82 contacts the chordal seal 38 as shown in FIG. 4. The contact between the chordal seal 38 and the second attachment flange 82 creates a seal that prevents hot gases flowing along the gas path 25 from escaping radially outwardly.

A method of assembling the turbine shroud assembly 23 may include several steps. The method begins by arranging the blade track segment 28 adjacent the carrier segment 26 so that the first and second attachment flanges 80, 82 of the attachment feature are adjacent the carrier segment 26. The blade track segment 28 is arranged adjacent the carrier segment 26 so that the first attachment flange 80 is located axially between the first mount flange 70 and the third mount flange 74 and the second attachment flange 82 is located axially between the second mount flange 72 and the fourth mount flange 76.

Then, each of the mount pins 32, 33 are inserted into the carrier segment 26 and through the blade track segment 28. Each of the mount pins 32, 33 are first inserted through the pin hole 91 of the first mount flange 70, through the first attachment flange 80 of the blade track segment 28, through the pin holes 95, 97 of the third and fourth mount flanges 74, 76, through the second attachment flange 82 of the blade track segment 28, and into the blind hole 93 of the second mount flange 72. In this way, the blade track segment 28 is coupled to the carrier segment 26.

Once the mount pins 32, 33 are inserted, the method includes inserting the corresponding mount insert 34, 35 into the pin hole 91 of the first mount flange 70 of the carrier segment 26. The mount insert 34, 35 is inserted into the pin hole 91 until the aft face 64 of the mount insert 34 engages the mount insert blocker surface 92 of the first mount flange 70.

Next, the method includes threading the mount plug 36, 37 to the corresponding mount insert 34, 35 to apply the axial force F to the corresponding mount pin 32, 33. The axial force F is applied to the mount pins 32, 33 to urge the attachment feature 80, 82 of the blade track segment 28 into engagement with the chordal seal 38 formed on the second mount flange 72 to axially locate the mount pins 32, 33 and the blade track segment 28 relative to the carrier segment 26.

Figure 5:
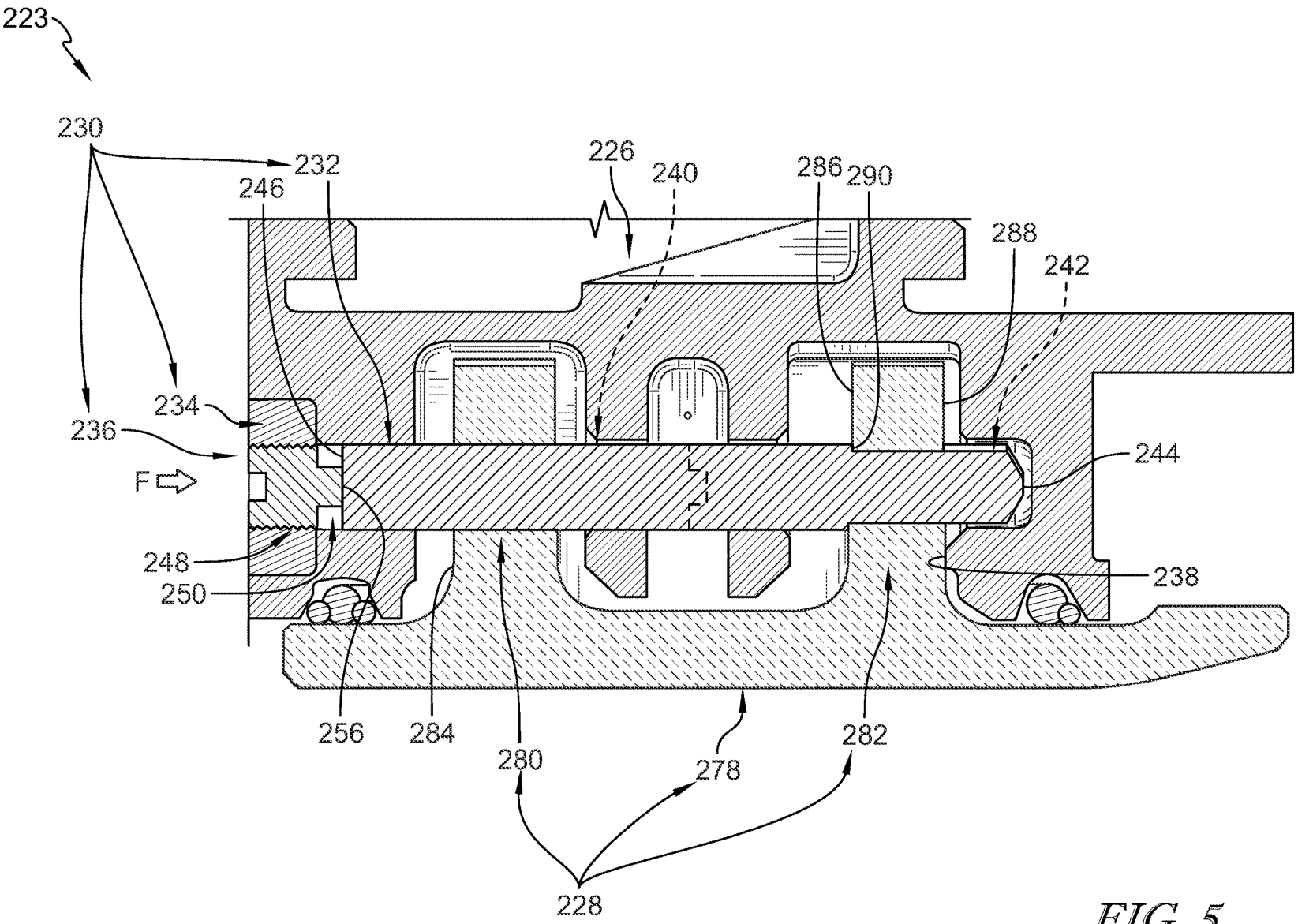
FIG. 5 is a detailed view of another embodiment of a turbine shroud assembly adapted for use in the gas turbine engine of FIG. 1 showing that the turbine shroud assembly includes a carrier segment, a blade track segment having a shroud wall and radially extending attachment flanges, and a mount assembly configured to couple the blade track segment to the carrier segment, the mount assembly including a mount pin, a mount insert press fit with the carrier segment axially forward of the mount pin, and a mount plug that mates with corresponding threads on the mount insert to apply an axial force to the mount pin to cause a step face of the mount pin to engage a second attachment flange of the blade track segment that is axially aft of a first attachment flange of the blade track segment so that the blade track segment is urged into engagement with a chordal seal formed on the carrier segment.

Another embodiment of a turbine shroud assembly 223 in accordance with the present disclosure is shown in FIG. 5. The turbine shroud assembly 223 is substantially similar to the turbine shroud assembly 23 shown in FIGS. 1-4 and described herein. Accordingly, similar reference numbers in the 200 series indicate features that are common between the turbine shroud assembly 23 and the turbine shroud assembly 223. The description of the turbine shroud assembly 23 is incorporated by reference to apply to the turbine shroud assembly 223, except in instances when it conflicts with the specific description and the drawings of the turbine shroud assembly 223.

The turbine shroud assembly 223 includes a carrier segment 226, a blade track segment 228, and a mount assembly 230 as shown in FIG. 5. The mount assembly 230 is configured to couple the blade track segment 228 to the carrier segment 226.

The mount assembly 230 includes a mount pin 232, a mount insert 234, and a mount plug 236 as shown in FIG. 5. The mount pin 232 extends into the carrier segment 226 and through first and second attachment flanges 280, 282 of the blade track segment 228 to couple the blade track segment 228 to the carrier segment 226. The mount insert 234 is press fit into the carrier segment 226 axially forward of the mount pin 232 and circumferentially aligned with the mount pin 232. The mount plug 236 is configured to mate with corresponding threads on the mount insert 234 to apply an axial force F to the mount pin 232. The axial force F applied by the mount plug 236 urges the blade track segment 228 into engagement with a chordal seal 238 formed on the carrier segment 226 to axially locate the mount pin 232 and the blade track segment 228 relative to the carrier segment 226.

In the illustrative embodiment, the mount pin 232 is formed to include a step 290 that defines an axially facing step face that engages the second attachment flange 282 of the blade track segment 228 as shown in FIG. 5. In this embodiment, the step 290 contacts an axially forward facing surface 286 of the second attachment flange 282 to urge the blade track segment 228 into engagement with the chordal seal 238 of the carrier segment 226. The step 290 of the mount pin 232 engages the axially forward facing surface 286 of the second attachment flange 282 as opposed to the axially forward facing surface 284 of the first attachment flange 280 as in the embodiment of FIG. 4. The chordal seal 238 still engages an axially aft facing surface 288 of the second attachment flange 282 as shown in FIG. 5.

The mount plug 236 still engages a forward end 246 of the mount pin 232 opposite an aft end 244 that extends into the carrier segment 226. The mount plug 236 engages the forward end 246 that defines an axially forward facing surface of the mount pin 232.

The mount plug 236 includes a main body 248 and a tab 250 as shown in FIG. 5. The main body 248 forms threads that mate with corresponding threads on the mount insert 234. The tab 250 extends axially aft from the main body 248 to a terminal end 256 that engages the forward end 246 of the mount pin 232. Terminal end 256 of the tab 250 engages the forward end 246 of the mount pin 232 to apply the axial force F to the mount pin 232. The axial force F urges the step 290 on the mount pin 232 into engagement with the blade track segment 228 to then urge the blade track segment 228 into sealing engagement with the chordal seal 238 formed on the carrier segment 226.

In some embodiments where the mount pin 232 is a split pin with a forward pin 240 and an aft pin 242, the mount plug 236 engages the forward pin 240 to urge the step 290 formed on the aft pin 242 into engagement with the blade track segment 228 thereby urging the blade track segment 228 into engagement with the chordal seal 238.

In the illustrative embodiment, the blade track segment 228 includes a shroud wall 278 and attachment flanges 280, 282 as shown in FIG. 5. The shroud wall 278 is arcuate and extends circumferential partway around the axis 11. The attachment flanges 280, 282 extends radially outward from the shroud wall 278 as shown in FIG. 5.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine shroud assembly for use with a gas turbine engine, the turbine shroud assembly comprising:

a carrier segment made of metallic materials and arranged circumferentially at least partway around an axis, the carrier segment having an outer wall, a first mount flange that extends radially inward from the outer wall, and a second mount flange axially spaced apart from the first mount flange and that extends radially inward from the outer wall, the second mount flange including a radially extending wall and a chordal seal that extends axially away from the radially extending wall, a blade track segment made of ceramic matrix composite materials and supported by the carrier segment to locate the blade track segment radially outward of the axis and define a portion of a gas path of the turbine shroud assembly, the blade track segment including a shroud wall that extends circumferentially partway around the axis and an attachment feature that extends radially outward from the shroud wall, and a mount assembly including a mount pin that extends into the first mount flange, through the attachment feature, and into the second mount flange so as to couple the blade track segment to the carrier segment, a mount insert that is press fit into the first mount flange of the carrier segment axially forward of the mount pin and circumferentially aligned with the mount pin, and a mount plug configured to mate with corresponding threads on the mount insert to apply an axial force to the mount pin to urge the attachment feature of the blade track segment into engagement with the chordal seal of the second mount flange to axially locate the mount pin and the blade track segment relative to the carrier segment.

2. The turbine shroud assembly of claim 1, wherein the mount plug includes a main body shaped to include threads that mate with corresponding threads on the mount insert and a tab that extends axially away from the main body and engages an axially forward facing surface of the mount pin.

3. The turbine shroud assembly of claim 2, wherein the first mount flange of the carrier segment is formed to define a stepped pin hole that extends axially through the first mount flange and configured to receive the mount insert and the mount plug, the stepped pin hole shaped to include a step surface spaced apart axially from an axially forward facing surface of the first mount flange, and the mount insert engages the step surface when the mount insert is press fit into the carrier segment to axially locate the mount insert relative to the first mount flange of the carrier segment.

4. The turbine shroud assembly of claim 3, wherein the mount pin is shaped to include a step defining an axially facing step face that engages the attachment feature to urge the attachment feature into engagement with the chordal seal.

5. The turbine shroud assembly of claim 1, wherein the mount pin is shaped to include a step defining an axially facing step face that engages the attachment feature to urge the attachment feature into engagement with the chordal seal.

6. The turbine shroud assembly of claim 5, wherein the attachment feature includes a first attachment flange that extends radially from the shroud wall and a second attachment flange spaced apart axially aft from the first attachment flange that extends radially from the shroud wall, and the axially facing step face of the step included in the mount pin engages the second attachment flange.

7. The turbine shroud assembly of claim 6, wherein the mount pin includes a forward pin that extends into the first mount flange and through the first attachment flange, and an aft pin circumferentially aligned with and aft of the forward pin that extends through the second attachment flange and into the second mount flange, and wherein the forward pin is separate from the aft pin so as to allow for independent loading during use in the gas turbine engine.

8. The turbine shroud assembly of claim 5, wherein the attachment feature includes a first attachment flange that extends radially from the shroud wall and a second attachment flange spaced apart axially aft from the first attachment flange that extends radially from the shroud wall, and the axially facing step face of the step included in the mount pin engages the first attachment flange.

9. The turbine shroud assembly of claim 1, wherein the mount insert and the mount plug comprise the same metallic materials to prevent the threads from seizing, and the metallic materials of the mount insert and the mount plug are different from the metallic materials of the carrier segment.

10. A turbine shroud assembly for use with a gas turbine engine, the turbine shroud assembly comprising:

a carrier segment arranged circumferentially at least partway around an axis, the carrier segment having an outer wall, a first mount flange that extends radially inward from the outer wall, and a second mount flange axially spaced apart from the first mount flange and that extends radially inward from the outer wall, the second mount flange shaped to include a chordal seal, a blade track segment supported by the carrier segment, the blade track segment including a shroud wall that extends circumferentially partway around the axis and an attachment feature that extends radially outward from the shroud wall, and a mount assembly including a mount pin that extends into the first mount flange, through the attachment feature, and into the second mount flange so as to couple the blade track segment to the carrier segment, a mount insert that is press fit into the first mount flange of the carrier segment axially forward of the mount pin and circumferentially aligned with the mount pin, and a mount plug configured to mate with corresponding threads on the mount insert to apply an axial force to the mount pin.

11. The turbine shroud assembly of claim 10, wherein the mount plug includes a main body and a tab that extends axially away from the main body and engages the mount pin.

12. The turbine shroud assembly of claim 11, wherein the first mount flange of the carrier segment is formed to define a stepped pin hole that extends axially through the first mount flange and configured to receive the mount insert and the mount plug, the stepped pin hole shaped to include a step surface spaced apart axially from an axially forward facing surface of the first mount flange, and the mount insert engages the step surface when the mount insert is press fit into the carrier segment to axially locate the mount insert relative to the first mount flange of the carrier segment.

13. The turbine shroud assembly of claim 10, wherein the mount pin is shaped to include a step defining an axially facing step face that engages the attachment feature to urge the attachment feature into engagement with the chordal seal.

14. The turbine shroud assembly of claim 13, wherein the attachment feature includes a first attachment flange that extends radially from the shroud wall and a second attachment flange spaced apart axially aft from the first attachment flange that extends radially from the shroud wall, and the axially facing step face of the step included in the mount pin engages the second attachment flange.

15. The turbine shroud assembly of claim 13, wherein the attachment feature includes a first attachment flange that extends radially from the shroud wall and a second attachment flange spaced apart axially aft from the first attachment flange that extends radially from the shroud wall, and the axially facing step face of the step included in the mount pin engages the first attachment flange.

16. The turbine shroud assembly of claim 1, wherein the mount insert and the mount plug comprise the same metallic materials, and the metallic materials of the mount insert and the mount plug are different from the metallic materials of the carrier segment.

17. A method comprising:

providing a carrier segment made of metallic materials arranged to extend circumferentially at least partway around an axis, a blade track segment made of ceramic matrix composite materials, and a mount assembly, the carrier segment having an outer wall, a first mount flange that extends radially inward from the outer wall, and a second mount flange axially spaced apart from the first mount flange and that extends radially inward from the outer wall and the second mount flange shaped to include a chordal seal, the blade track segment including a shroud wall that extends circumferentially partway around the axis and an attachment feature that extends radially outward from the shroud wall, and the mount assembly including a mount pin, a mount insert, and a mount plug, arranging the blade track segment adjacent the carrier segment so that the attachment feature is adjacent the second mount flange of the carrier segment, inserting the mount pin into the first mount flange, through the attachment feature, and into the second mount flange so as to couple the blade track segment to the carrier segment, inserting the mount insert into the first mount flange of the carrier segment after inserting the mount pin, and threading the mount plug to the mount insert to apply an axial force to the mount pin to urge the attachment feature of the blade track segment into engagement with the chordal seal formed on the second mount flange to axially locate the mount pin and the blade track segment relative to the carrier segment.

18. The method of claim 17, wherein the mount insert and the mount plug comprise the same metallic materials, and the metallic materials of the mount insert and the mount plug are different from the metallic materials of the carrier segment.

19. The method of claim 17, wherein the mount plug includes a main body shaped to include threads that mate with corresponding threads on the mount insert and a tab that extends axially away from the main body and engages an axially forward facing surface of the mount pin.

20. The method of claim 17, wherein the attachment feature includes a first attachment flange that extends radially from the shroud wall and a second attachment flange spaced apart axially aft from the first attachment flange that extends radially from the shroud wall, and wherein the mount pin is shaped to include a step defining an axially facing step face that engages the second attachment flange to urge the attachment feature into engagement with the chordal seal.

* * * * *